US005489198A

United States Patent [19]

Comparin et al.

[11] Patent Number: 5,489,198

[45] Date of Patent: Feb. 6, 1996

[54] SCROLL MACHINE SOUND ATTENUATION

[75] Inventors: Robert J. Comparin, Troy; Kent E. Logan, Englewood, both of Ohio

[73] Assignee: Copeland Corporation, Sidney, Ohio

[21] Appl. No.: 231,620

[22] Filed: Apr. 21, 1994

[51] Int. Cl.[6] ..... F01C 1/04

[52] U.S. Cl. ..... 418/55.5; 418/57

[58] Field of Search ..... 418/55.3, 55.5, 418/57

[56] References Cited

U.S. PATENT DOCUMENTS

| | | | |
|---|---|---|---|
| 3,874,827 | 4/1975 | Young | 418/57 |
| 4,413,959 | 11/1983 | Butterworth | 418/55.5 |
| 4,457,675 | 7/1984 | Inagaki et al. | 418/57 |
| 4,575,318 | 3/1986 | Blain | 418/57 |
| 4,580,956 | 4/1986 | Takahashi et al. | 418/57 |
| 4,610,610 | 9/1986 | Blain | 418/57 |
| 4,673,339 | 6/1987 | Hayano et al. | 418/15 |
| 4,708,607 | 11/1987 | Hayano et al. | 418/57 |
| 4,927,339 | 5/1990 | Riffe et al. | 418/55.5 |
| 4,927,340 | 5/1990 | McCullough | 418/55.3 |
| 5,242,282 | 9/1993 | Mitsunaga et al. | 418/55.3 |

FOREIGN PATENT DOCUMENTS

| | | | |
|---|---|---|---|
| 1159481 | 6/1989 | Japan | 418/55.5 |
| 1262391 | 10/1989 | Japan | 418/55.5 |
| 3164587 | 7/1991 | Japan | 418/55.5 |
| 5248371 | 9/1993 | Japan | 418/55.5 |

*Primary Examiner*—John J. Vrablik

*Attorney, Agent, or Firm*—Harness, Dickey & Pierce

[57] ABSTRACT

A scroll-type machine has a motion controlling member for preventing relative rotation between a first and a second scroll member while allowing relative orbiting motion therebetween. The scroll-type machine includes a novel arrangement of a spring or other flexible member for biasing the second scroll member in a torsional direction. Biasing of the second scroll member operates to reduce the mechanical impact noise or rattle which is caused by the vibration of the machines operating components.

16 Claims, 8 Drawing Sheets

SCROLL MACHINE SOUND ATTENUATION

FIELD OF THE INVENTION

The present invention relates to scroll-type machinery. More particularly, the present invention relates to a novel method and apparatus for attenuating noise generated during the operation of the scroll-type machinery.

BACKGROUND AND SUMMARY OF THE INVENTION

Scroll machinery for fluid compression or expansion is typically comprised of two upstanding interfitting involute spirodal wraps or scrolls which are generated about respective axes. Each respective scroll is mounted upon an end plate and has a tip disposed in contact or near contact with the end plate of the other respective scroll. Each scroll further has flank surfaces which adjoin, in moving line contact or near contact, the flank surfaces of the other respective scroll to form a plurality of moving chambers. Depending upon the relative orbital motion of the scrolls, the chambers move from the radially exterior ends of the scrolls to the radially interior ends of the scrolls for fluid compression, or from the radially interior ends of the scrolls to the radially exterior ends of the scrolls for fluid expansion. The scrolls, to accomplish the formation of the chambers, are put in relative orbital motion by a drive mechanism. Either one of the scrolls may orbit or both may rotate eccentrically with respect to one another.

A typical scroll machine, according to the design which has a non-orbiting scroll, includes an orbiting scroll which meshes with the non-orbiting scroll, a thrust bearing to take the axial loads on the orbiting scroll and a motion controlling member for preventing relative rotation of the scroll members. The motion controlling member preferred for preventing relative rotation of the scroll members is usually an Oldham coupling.

In the marketplace, there is an increasing demand for much quieter machinery than was hitherto acceptable, and this is especially true for air conditioning and heat pump systems. In the case of refrigerant compressors used for air conditioning and heat pump applications, sound has become an increasingly important criteria for judging acceptability. There are a number of identified sources of sound in a scroll compressor, many of which are relatively easily cured. A recently discovered source of sound which does not lend itself to easy cure, however, concerns the mechanical impact noise or rattle which is caused by vibration of the orbiting scroll member and the motion controlling member under certain operating conditions. These operating conditions include when the compressor is operating under lighter load conditions when there is insufficient loading of the compressor components including the orbiting scroll and the motion controlling member to prevent force reversals which can cause the orbiting scroll and other components of the compressor to impact noisily on the components of the compressor with which they interface.

Accordingly, it would be desirable to insure that there is sufficient loading of the orbiting scroll member at all operating conditions of the compressor to prevent the force reversals and thus eliminate the mechanical impact or rattle which is caused by the vibration of the orbiting scroll member and/or the motion controlling member.

It is therefore a primary objective of the present invention to provide means for biasing the orbiting scroll member in order to take up the normal build and operating clearances that are present in the scroll machinery which can contribute to the mechanical impact or rattle caused by the vibration of the orbiting scroll member and/or the motion controlling member.

Other advantages and objects of the present invention will become apparent to those skilled in the an from the subsequent detailed description, appended claims and drawings.

BRIEF DESCRIPTION OF THE DRAWINGS

In the drawings which illustrate the best mode presently contemplated for carrying out the present invention.

DESCRIPTION OF THE PREFERRED EMBODIMENT

Figure 1:
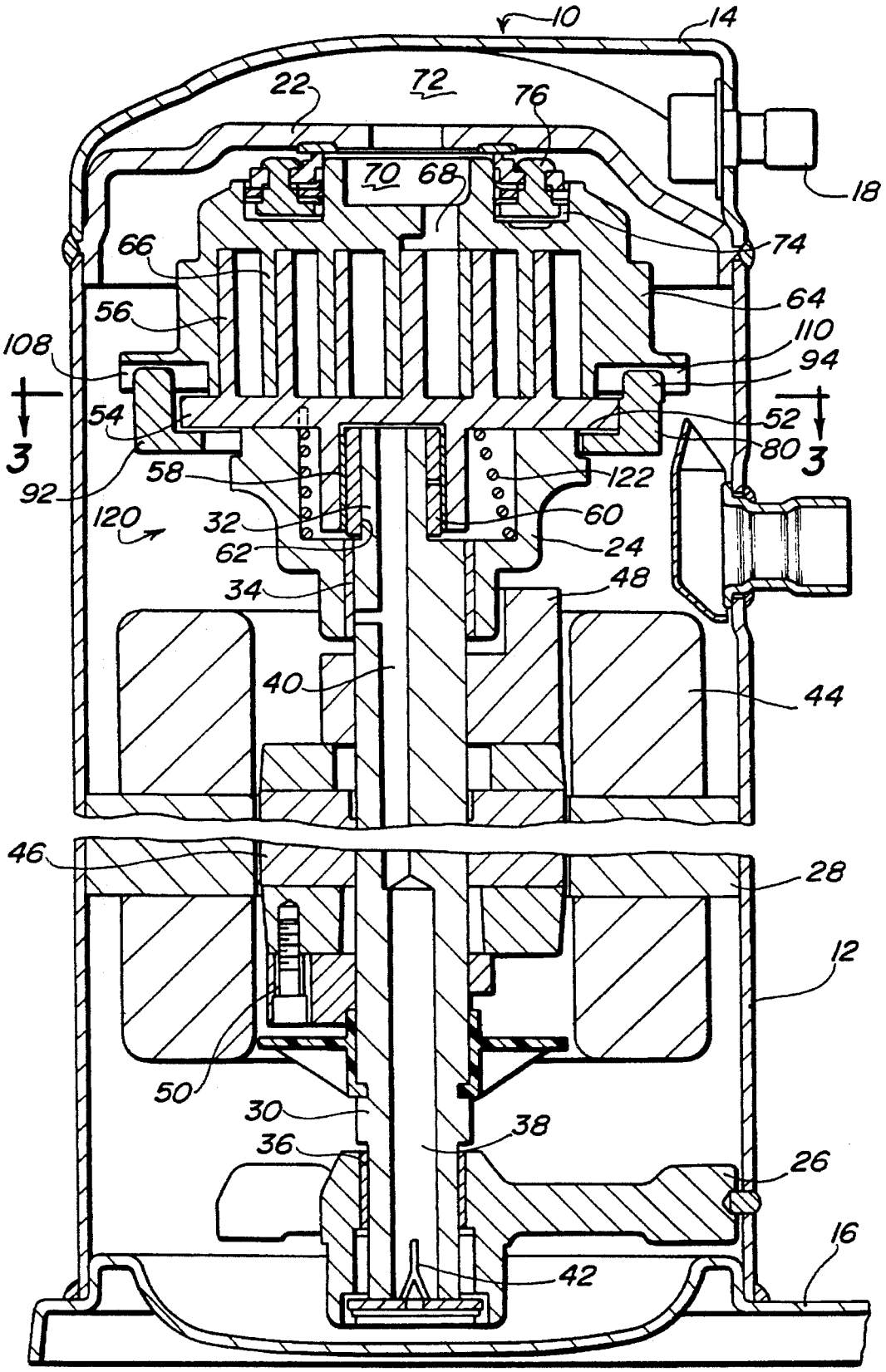
FIG. 1 is a vertical sectional view through the center of a scroll type refrigeration compressor incorporating a biased orbiting scroll in accordance with the present invention.

Referring now to the drawings in which like reference numerals designate like or corresponding parts throughout the several views, there is shown in FIG. 1, a compressor 10 which comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 which is suitably secured to shell 12 and a lower bearing housing 26 having a plurality of radially outwardly extending legs each of which is suitably secured to shell 12. A motor stator 28 which is generally square in cross-section but with the corners rounded off is press fitted into shell 12. The flats between the rounded corners on the stator provide passageways between the stator and shell which facilitate the return flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. Disposed within bore 38 is a stirrer 42. The lower portion of the interior shell 12 is filled with lubricating oil and bore 38 acts as a pump to pump lubricating fluid up the crankshaft 30 and into passageway 40 and ultimately to all of the various portions of the compressor which require lubrication.

Crankshaft 30 is rotatively driven by an electric motor including stator 28, windings 44 passing therethrough and a rotor 46 press fitted on crankshaft 30 and having upper and lower counterweights 48 and 50, respectively.

The upper surface of main bearing housing 24 is provided with a flat thrust bearing surface 52 on which is disposed an orbiting scroll 54 having the usual spiral vane or wrap 56 on the upper surface thereof. Projecting downwardly from the lower surface of orbiting scroll 54 is a cylindrical hub having a journal bearing 58 therein and in which is rotatively disposed a drive bushing 60 having an inner bore 62 in which crank pin 32 is drivingly disposed. Crank pin 32 has a flat on one surface which drivingly engages a flat surface (not shown) formed in a portion of inner bore 62 to provide a radially compliant driving arrangement, such as shown in assignee's U.S. Pat. No. 4,877,382, the disclosure of which is hereby incorporated herein by reference.

A non-orbiting scroll member 64 is also provided having a wrap 66 positioned in meshing engagement with wrap 56 of scroll 54. Non-orbiting scroll 64 has a centrally disposed discharge passage 68 which communicates with an upwardly open recess 70 which in turn is in fluid communication with a discharge muffler chamber 72 defined by cap 14 and partition 22. An annular recess 74 is also formed in non-orbiting scroll 64 within which is disposed a seal assembly 76. Recesses 70 and 74 and seal assembly 76 cooperate to define axial pressure biasing chambers which receive pressurized fluid being compressed by wraps 56 and 66 so as to exert an axial biasing force on non-orbiting scroll member 64 to thereby urge the tips of respective wraps 56, 66 into sealing engagement with the opposed end plate surfaces. Seal assembly 76 is preferably of the type described in greater detail in U.S. Pat. No. 5,156,539, the disclosure of which is hereby incorporated herein by reference. Scroll member 64 is designed to be mounted to main bearing housing 24 in a suitable manner such as disclosed in the aforementioned U.S. Pat. No. 4,877,382 or U.S. Pat. No. 5,102,316, the disclosure of which is hereby incorporated herein by reference.

An Oldham coupling 80 is provided as a motion controlling member and is positioned between orbiting scroll 54 and bearing housing 24. Oldham coupling 80 is keyed to both orbiting scroll 54 and non-orbiting scroll 64 to prevent rotational movement of orbiting scroll member 54 with respect to non-orbiting scroll 64. Oldham coupling 80 is preferably of the type disclosed in assignee's copending U.S. application Ser. No. 591,443, entitled "Oldham Coupling For Scroll Compressor" filed Oct. 1, 1990, now U.S. Pat. No. 5,320,506, the disclosure of which is hereby incorporated herein by reference.

Figure 4:
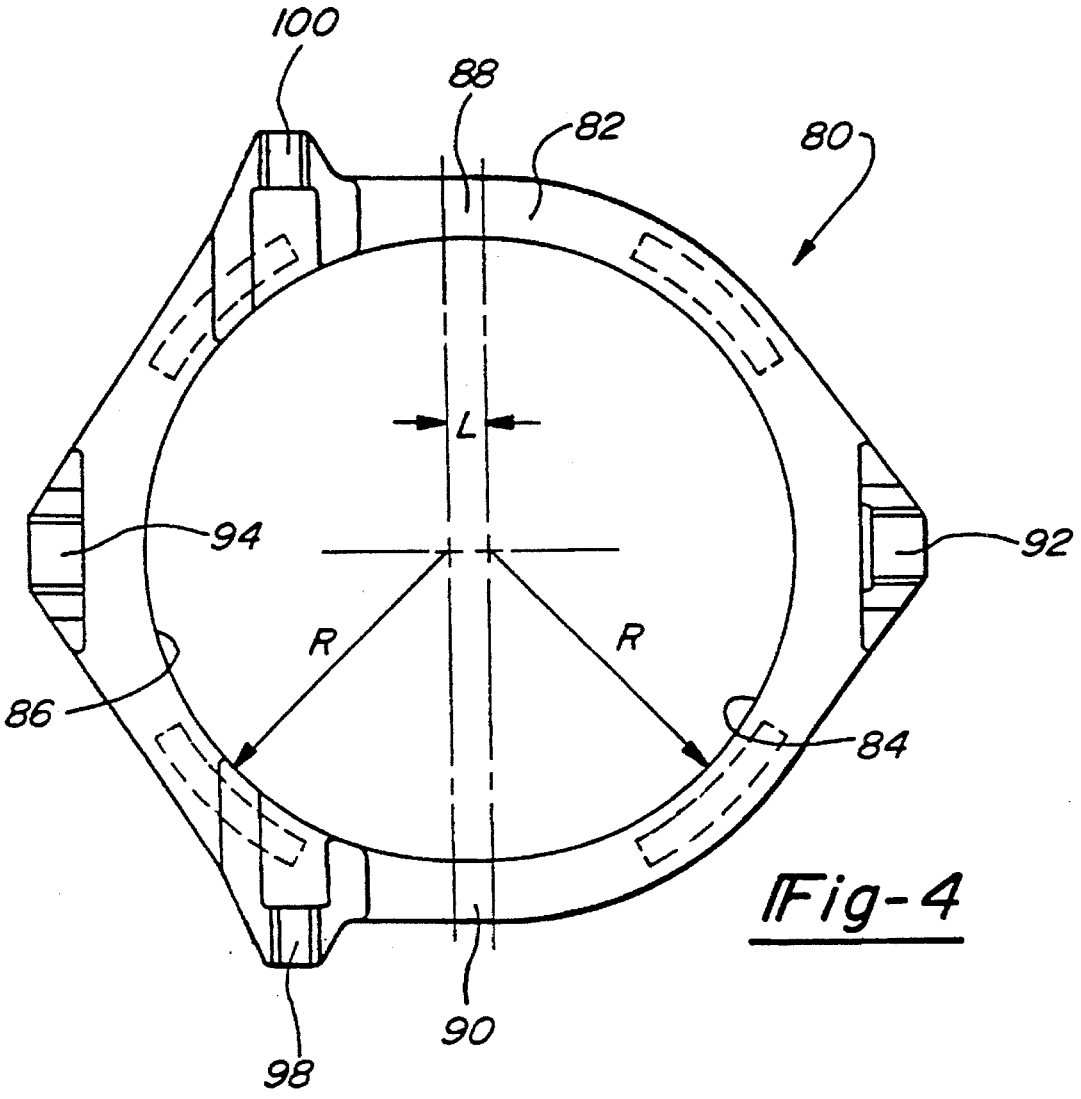
FIG. 4 is a plan view of the motion controlling member incorporated in the refrigeration compressor shown in FIGS. 1–3, all in accordance with the present invention.
Figure 5:
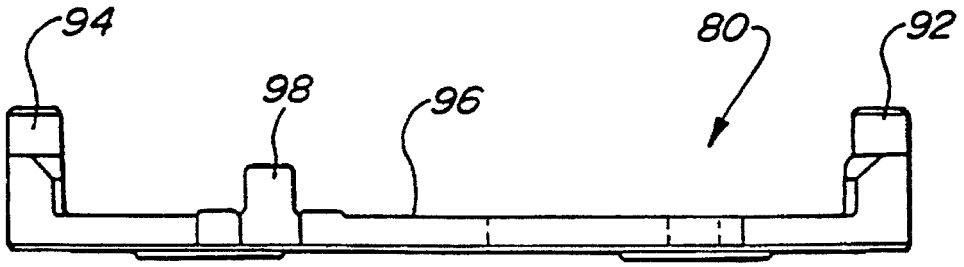
FIG. 5 is an elevational view of the motion controlling member of the present invention.

The present invention provides a unique arrangement for biasing orbiting scroll 54 along with Oldham coupling 80 with respect to shell 12 or main bearing housing 24. Oldham coupling 80, as best seen with reference to FIGS. 4 and 5, includes an annular ring portion 82, the inner periphery of which is non-circular in shape being defined by two generally circular arc segments 84, 86 each of a substantially constant radius R, the opposed ends of which are interconnected by substantially straight segments 88 and 90 of length L.

A pair of keys 92 and 94 are provided on annular ring 82 in diametrically aligned relationship and projecting axially upward from surface 96 thereof. A second pair of keys 98 and 100 are also provided on annular ring 82 also projecting axially upward from surface 96 thereof. Keys 98 and 100 are also aligned along a line extending parallel to a radius of arc 86 which radius is substantially perpendicular to the diameter along which keys 92 and 94 are aligned but shifted towards key 94. Additionally, keys 98 and 100 are positioned on outwardly projecting flange portions. Both the radial shifting and outward positioning of keys 98 and 100 cooperate to enable the size of Oldham coupling 80 to be kept to a minimum for a given size compressor and associated shell diameter while enabling the size of thrust surface 52 to be maximized for this same compressor as well as to avoid interference with the location and extent of wrap 56 of orbiting scroll member 54.

Figure 3:
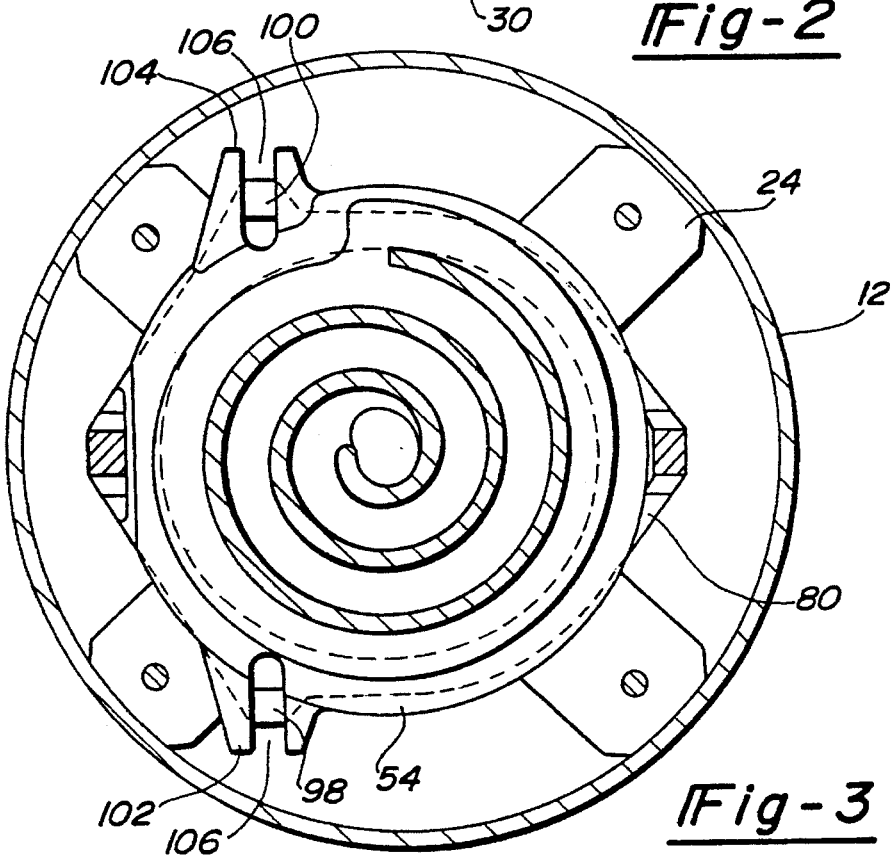
FIG. 3 is a section view of the refrigeration compressor of FIG. 1, the section being taken along line 3—3 thereof.

As shown in FIG. 3, the end plate of orbiting scroll member 54 is provided with a pair of outwardly projecting flange portions 102 and 104, each of which is provided with an outwardly opening slot 106. Slots 106 are sized to slidingly receive a respective key 98 and 100 axially extending from Oldham coupling 80. Keys 98 and 100 will, of course, have an axial length or height so as to avoid projecting above the upper surface of the end plate of orbiting scroll member 54.

Referring once again to FIG. 1, non-orbiting scroll 64 is similarly provided with a pair of radially extending aligned slots 108 and 110 which are designed to receive respective keys 92 and 94. Of course, keys 92 and 94 will be substantially longer than the keys 98 and 100 and of sufficient length to project above the end plate of scroll 54 and remain in engagement with slots 108 and 110 throughout the limited axial movement of non-orbiting scroll 64 noted above. It should be noted, however, that preferably a slight clearance will be provided between the end of respective keys 92 and 94 and the overlying surfaces of respective slots 108 and 110 when scroll member 64 is fully seated against scroll member 54 thereby avoiding any possibility of interference with the tip sealing between the respective scroll members.

As may now be appreciated, Oldham coupling 80 serves to directly interconnect and prevent any relative rotation between scroll members 54 and 64 through the cooperative action of the abutment surfaces provided by respective slots 106, 108 and 110 and associated keys 98, 100, 92, and 94. Similarly, the mounting arrangement of non-orbiting scroll 64 to bearing housing 24 will operate to effectively prevent relative rotation of non-orbiting scroll member 64 with respect to bearing housing 24 and hence also prevent relative rotation of orbiting scroll member 54 with respect to bearing housing 24.

Figure 2:
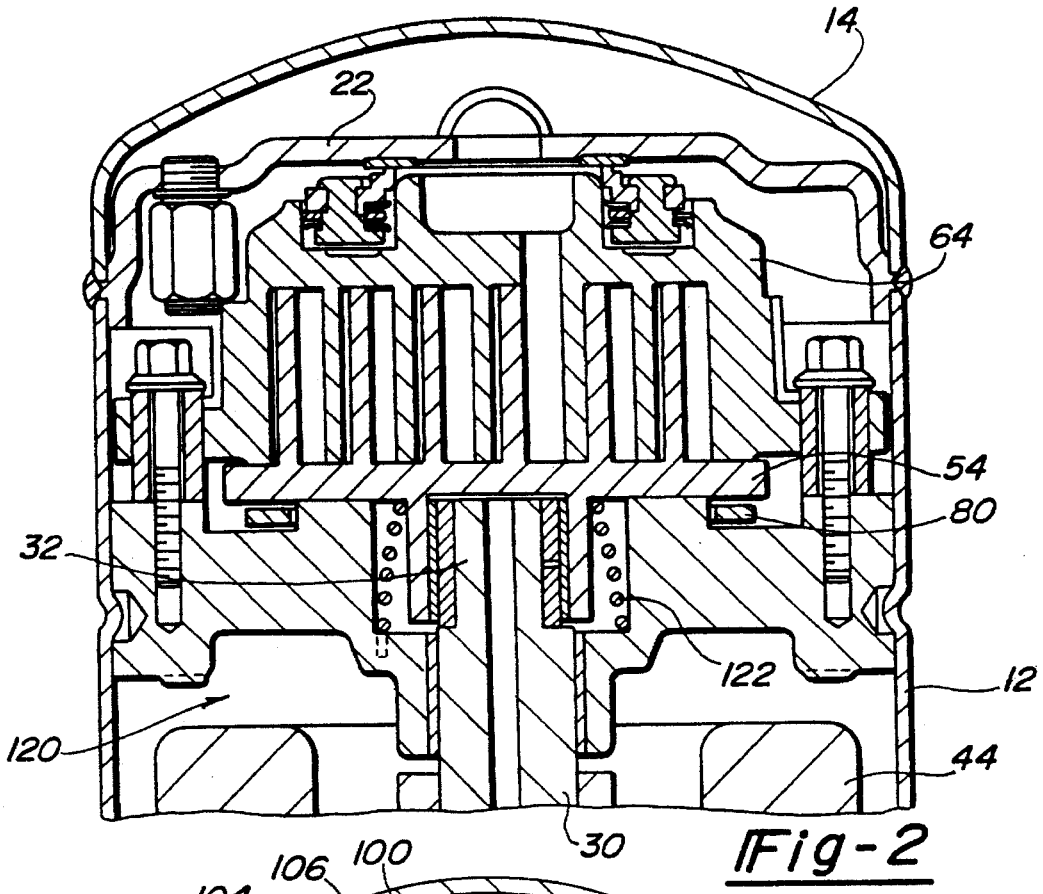
FIG. 2 is a fragmentary section view similar to that of FIG. 1 but with the section being taken along a plane passing through the non-orbiting scroll mounting arrangement, all in accordance with the present invention.

The present invention utilizes biasing means for applying a load to orbiting scroll member 54 in order to take up the manufacturing, operating and wear clearances. The embodiment shown in FIGS. 1 through 3 illustrates the biasing means of the present invention which is designated generally by the reference numeral 120. Biasing means 120 comprises a torsional spring 122. Torsional spring 122 is secured to the end plate or the cylindrical hub of orbiting scroll 54 at one end and to main bearing housing 24 at the opposite end. Torsional spring 122 is preloaded in torsion to provide the desired moment load on orbiting scroll 54. Torsional spring 122 is flexible in the lateral direction to accommodate the orbiting motion of orbiting scroll 54. Torsional spring 122 may be tapered to provide additional clearance between the cylindrical hub on orbiting scroll 54 and main bearing housing 24 if desired.

While the above embodiment shown in FIGS. 1 through 3 illustrate torsional spring 122 being disposed between orbiting scroll member 54 and main bearing housing 24, it is to be understood that torsional spring 122 may be disposed between orbiting scroll member 54 and any other non-orbiting member of compressor 10 including non-orbiting scroll 64 or shell 12.

Figure 6:
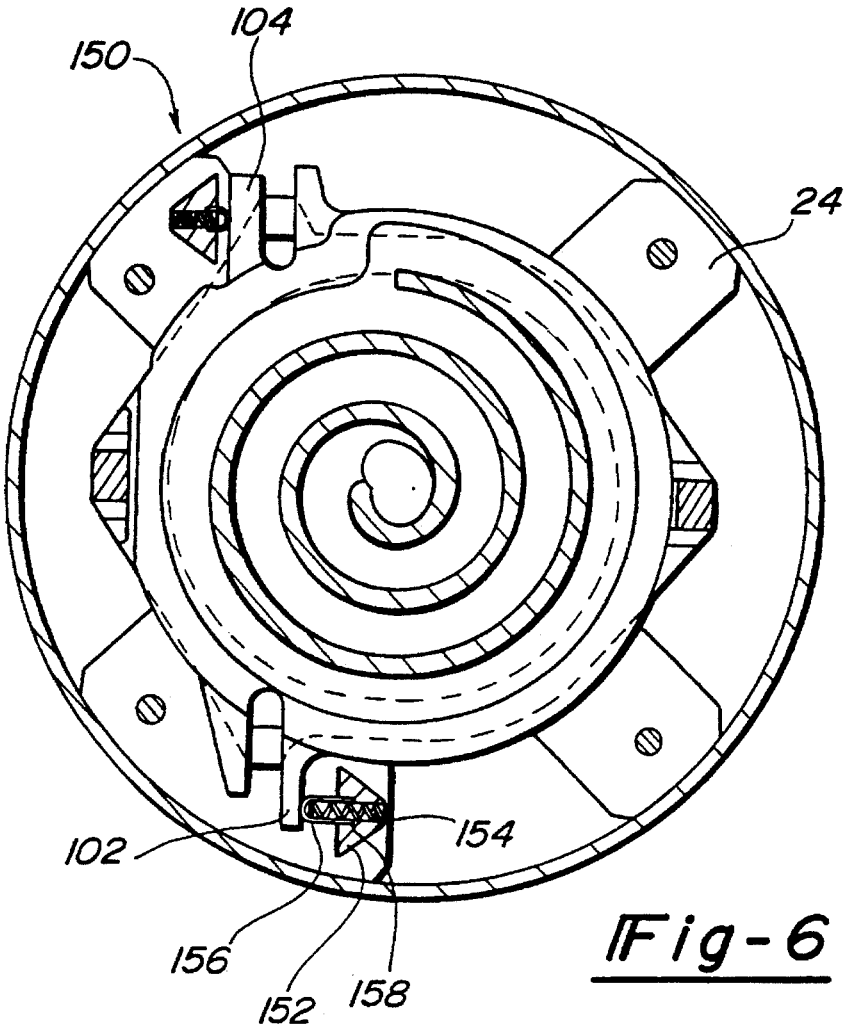
FIG. 6 is a section view similar to that of FIG. 3 but showing another embodiment of the present invention.
Figure 7:
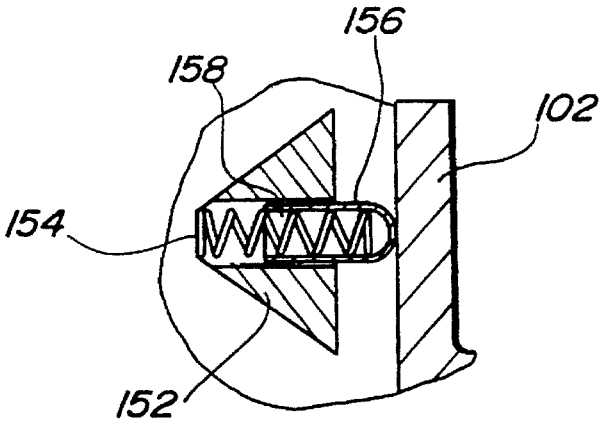
FIG. 7 is an enlarged view of one of the biasing means shown in FIG. 6.

FIGS. 6 and 7 show another embodiment of the biasing means of the present invention which is designated generally by the reference numeral 150. In the embodiment shown in FIGS. 6 and 7, main bearing housing 24 is provided with a pair of pads 152 each of which is adapted for mounting a coil spring 154 and a plunger 156. Coil spring 154 and plunger 156 are disposed within an aperture 158 located within each pad 152. Coil spring 154 biases plunger 156 outward against outwardly projecting flange portions 102 and 104 of orbiting scroll 54 to provide a torsional moment to orbiting scroll 54. The rate of compression of coil spring 154 in conjunction with the positioning of pads 152 determines the desired moment loading. In the preferred embodiment, plungers 156 are shown as a pair of plungers in order to provide a pure moment load. It is to be understood that only one plunger 156 could be used if desired. The ends of plungers 156 are rounded and are designed to slide along flange portions 102 and 104 of orbiting scroll 54. Thus, to accommodate the orbiting motion of orbiting scroll 54, plungers 156 will both slide along flange portions 102 and 104 as well as move in and out of apertures 158.

Figure 8:
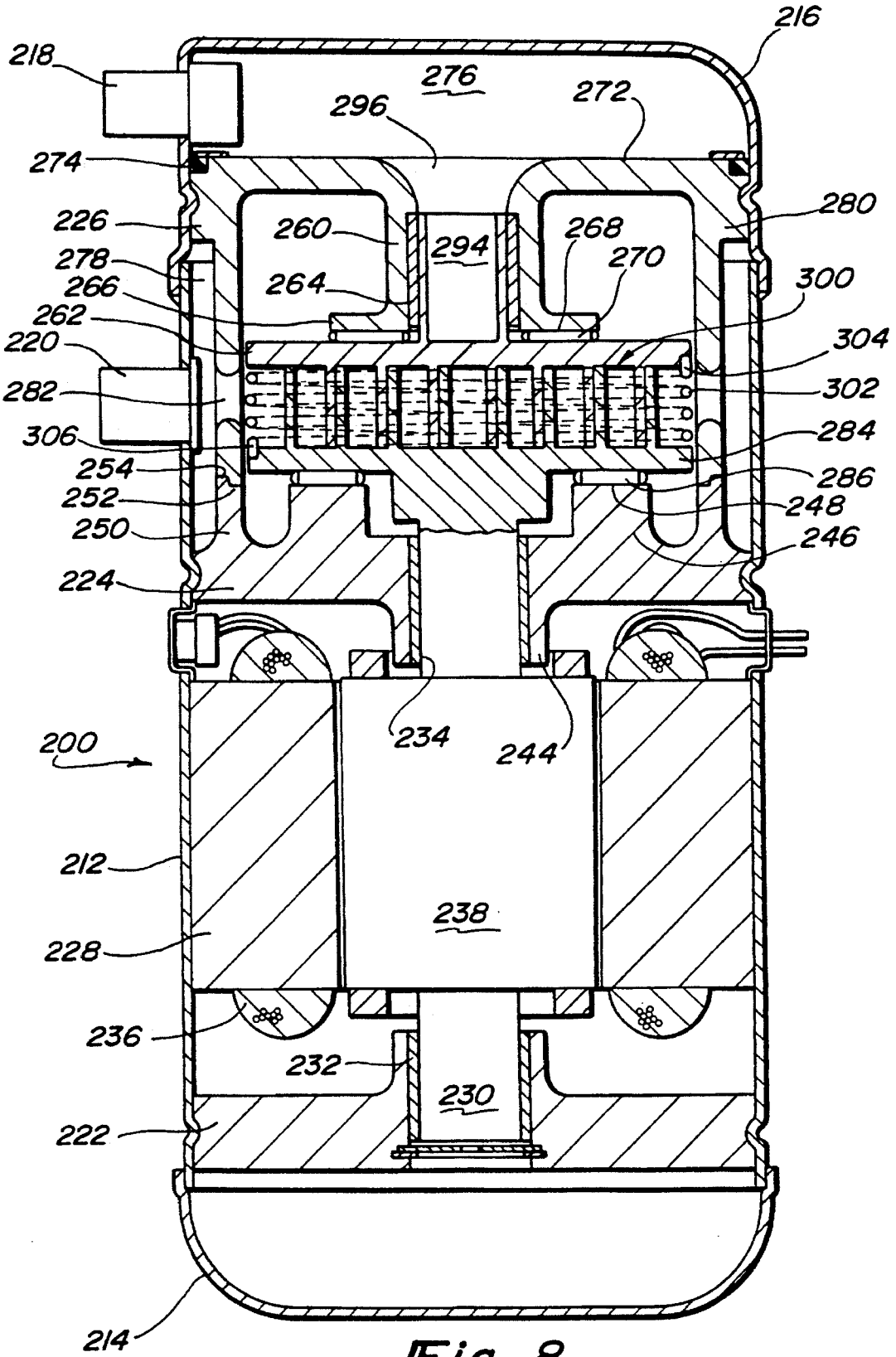
FIG. 8 is a vertical sectional view through the center of a dual rotating scroll type refrigerant compressor incorporating a biasing of the scrolls in accordance with another embodiment of the present invention.

Referring now to FIG. 8, there is shown a scroll compressor 200 incorporating the biasing system of the present invention. Compressor 200 comprises a cylindrical hermetic shell 212 having welded at the lower end thereof a cover 214 and at the upper end thereof a cap 216. Cap 216 is provided with a refrigerant discharge fitting 218 optionally having the usual discharge valve therein (not shown). Other members affixed within the hermetic shell formed by shell 212, cover 214 and cap 216 include a suction gas inlet fitting 220, a lower bearing housing 222, an intermediate bearing housing 224, an upper bearing housing 226 and a motor stator 228. Lower bearing housing 222 is affixed to shell 212 at its outer periphery by methods known well in the art.

A driveshaft 230 is rotatably journaled in a bearing 232 located in lower bearing housing 222 and in a bearing 234 located in intermediate bearing housing 224. Similar to the compressor shown in FIG. 1, driveshaft 230 has the usual oil pumping bores (not shown) and the lower portion of cylindrical shell 212 is filled with lubricating oil in the usual manner and the pump located within driveshaft 230 is the primary pump which pumps lubricating fluid to all the various portions of compressor 200 which require lubrication. Driveshaft 230 is rotatably driven by an electric motor including motor stator 228 having motor windings 236 passing therethrough, and a motor rotor 238 press fit on driveshaft 230.

Intermediate bearing housing 224 has a generally cylindrical shaped central portion 244 within which the upper end of driveshaft 230 is rotatably supported by bearing 234. An upstanding annular projection 246 is provided on intermediate bearing housing 224 adjacent the outer periphery of central portion 244 and includes an upwardly facing bearing surface 248. An annular section 250 extends generally radially outwardly from annular projection 246 and includes a step 252 which is designed to mate with a corresponding step 254 provided on upper bearing housing 226 for aiding in radially positioning upper bearing housing 226 with respect to intermediate bearing housing 224. The exterior surface of annular section 250 is adapted for mating with shell 212 to fixedly secure intermediate bearing housing 224 within shell 212 by methods well known in the art.

Upper bearing housing 226 has a generally cylindrical shaped central portion 260 within which an upper scroll member 262 is rotatably supported by a bearing 264. An annular flange 266 extends radially outward from the lower end of central portion 260 to provide a bearing surface 268 for upper scroll member 262. A bearing 270 is positioned between bearing surface 268 and upper scroll member 262. An annular wall 272 extends radially outward from the upper end of central portion 260 and is fixedly secured at its periphery to shell 212 by means known well in the art. A seal 274 seals the upper discharge zone 276 from the lower suction zone 278. A generally cylindrical section 280 extends downward from annular wall 272 and includes step 254 which matingly engages step 252. A plurality of apertures 282 are provided through cylindrical section 280 to allow gas at suction pressure to enter the compressor section.

A lower scroll 284 is fixedly secured for rotation to driveshaft 230 and is supported on bearing surface 248 by a bearing 286. Lower scroll 284 is intermeshed with upper scroll 262 and both upper and lower scrolls 262 and 284 rotate together, but on different axes, whereby the spiral wraps will create pockets of progressively decreasing volume from suction zone 278 to discharge zone 276. A mechanism (not shown) maintains the angular relationship between the spiral wraps of the two scrolls. Upper scroll 262 has a centrally disposed discharge passageway 294 communicating with discharge zone 276 through an opening 296 in upper bearing housing 226.

The scroll compressor as thus far broadly described is either now known in the art or is the subject matter of other pending applications for patent by applicant's assignee. The details of construction which incorporate the principles of the present invention are those which deal with a unique biasing system, indicated generally at 300. The biasing system 300 of the present invention includes a torsional spring 302 which is first preloaded and then secured to upper scroll 262 at 304 and to lower scroll 284 at 306. Torsional spring 302 is preloaded in torsion to provide the desired moment load between upper scroll 262 and lower scroll 284. The embodiment shown in FIG. 8 thus provides a unique arrangement for biasing lower scroll 284 with respect to upper scroll 262 in order to take up the manufacturing, operating and wear clearances.

Figure 9:
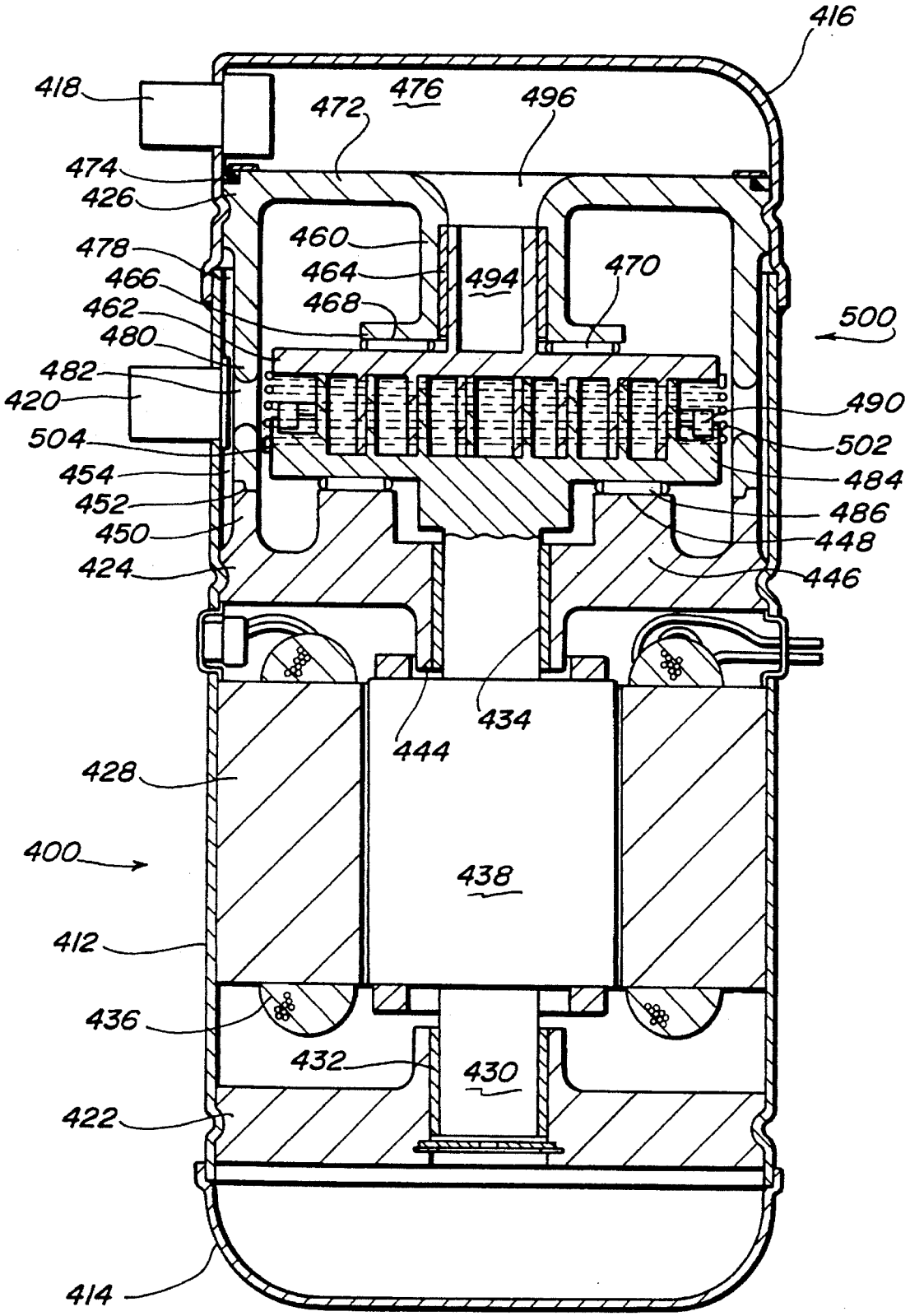
FIG. 9 is a vertical sectional view through the center of a dual rotating scroll type refrigerant compressor incorporating a biasing of the scrolls in accordance with another embodiment of the present invention.

Referring now to FIG. 9, there is shown a scroll compressor 400 incorporating the biasing system of the present invention. Compressor 400 comprises a cylindrical hermetic shell 412 having welded at the lower end thereof a cover 414 and at the upper end thereof a cap 416. Cap 416 is provided with a refrigerant discharge fitting 418 optionally having the usual discharge valve therein (not shown). Other members affixed within the hermetic shell formed by shell 412, cover 414 and cap 416 include a suction gas inlet fitting 420, a lower bearing housing 422, an intermediate bearing housing 424, an upper bearing housing 426 and a motor stator 428. Lower bearing housing 422 is affixed to shell 412 at its outer periphery by methods known well in the art.

A driveshaft 430 is rotatably journaled in a bearing 432 located in lower bearing housing 422 and in a bearing 434 located in intermediate bearing housing 424. Similar to the compressor shown in FIG. 1, driveshaft 430 has the usual oil pumping bores (not shown) and the lower portion of cylindrical shell 412 is filled with lubricating oil in the usual manner and the pump located within driveshaft 430 is the primary pump which pumps lubricating fluid to all the various portions of compressor 400 which require lubrication. Driveshaft 430 is rotatably driven by an electric motor including motor stator 428 having motor windings 436 passing therethrough, and a motor rotor 438 press fit on driveshaft 430.

Intermediate bearing housing 424 has a generally cylindrical shaped central portion 444 within which the upper end of driveshaft 430 is rotatably supported by bearing 434. An upstanding annular projection 446 is provided on intermediate bearing housing 424 adjacent the outer periphery of central portion 444 and includes an upwardly facing bearing surface 448. An annular section 450 extends generally radially outwardly from annular projection 446 and includes a step 452 which is designed to mate with a corresponding step 454 provided on upper bearing housing 426 for aiding in radially positioning upper bearing housing 426 with respect to intermediate bearing housing 424. The exterior surface of annular section 450 is adapted for mating with shell 412 to fixedly secure intermediate bearing housing 424 within shell 412 by methods well known in the art.

Upper bearing housing 426 has a generally cylindrical shaped central portion 460 within which an upper scroll member 462 is rotatably supported by a bearing 464. An annular flange 466 extends radially outward from the lower end of central portion 460 to provide a bearing surface 468 for upper scroll member 462. A bearing 470 is positioned between bearing surface 468 and upper scroll member 462. An annular wall 472 extends radially outward from the upper end of central portion 460 and is fixedly secured at its periphery to shell 412 by means known well in the art. A seal 474 seals the upper discharge zone 476 from the lower suction zone 478. A generally cylindrical section 480 extends downward from annular wall 472 and includes step 454 which matingly engages step 452. A plurality of apertures 482 are provided through cylindrical section 480 to allow gas at suction pressure to enter the compressor section.

A lower scroll 484 is fixedly secured for rotation to driveshaft 430 and is supported on bearing surface 448 by a bearing 486. Lower scroll 484 is intermeshed with upper scroll 462 and both upper and lower scrolls 462 and 484 rotate together, but on different axes, whereby the spiral wraps will create pockets of progressively decreasing volume from suction zone 478 to discharge zone 476. Upper scroll 462 has a centrally disposed discharge passageway 494 communicating with discharge zone 476 through an opening 496 in upper bearing housing 426.

An Oldham Coupling 490 is provided as a motion controlling member and is positioned between upper scroll 462 and lower scroll 484. Oldham Coupling 490 is keyed to both upper scroll 462 and lower scroll 484 to prevent rotational movement of upper scroll 462 with respect to lower scroll 484. The scroll compressor as thus far broadly described is either now known in the art or is the subject matter of other pending applications for patent by applicant's assignee. The details of construction which incorporate the principles of the present invention are those that deal with a unique biasing system, indicated generally at 500.

This biasing system 500 of the present invention includes a torsional spring 502 which is first preloaded and then secured to lower scroll 484 at 504 and to upper scroll 462 similar to the connection shown at 504. Torsional spring 502 is preloaded in torsion direction to provide the desired moment load between upper scroll 462 and lower scroll 484. In this manner, upper scroll 462 is torsionally biased with respect to lower scroll 484, the torsional load acting through the keys of Oldham Coupling 490.

Figure 10:
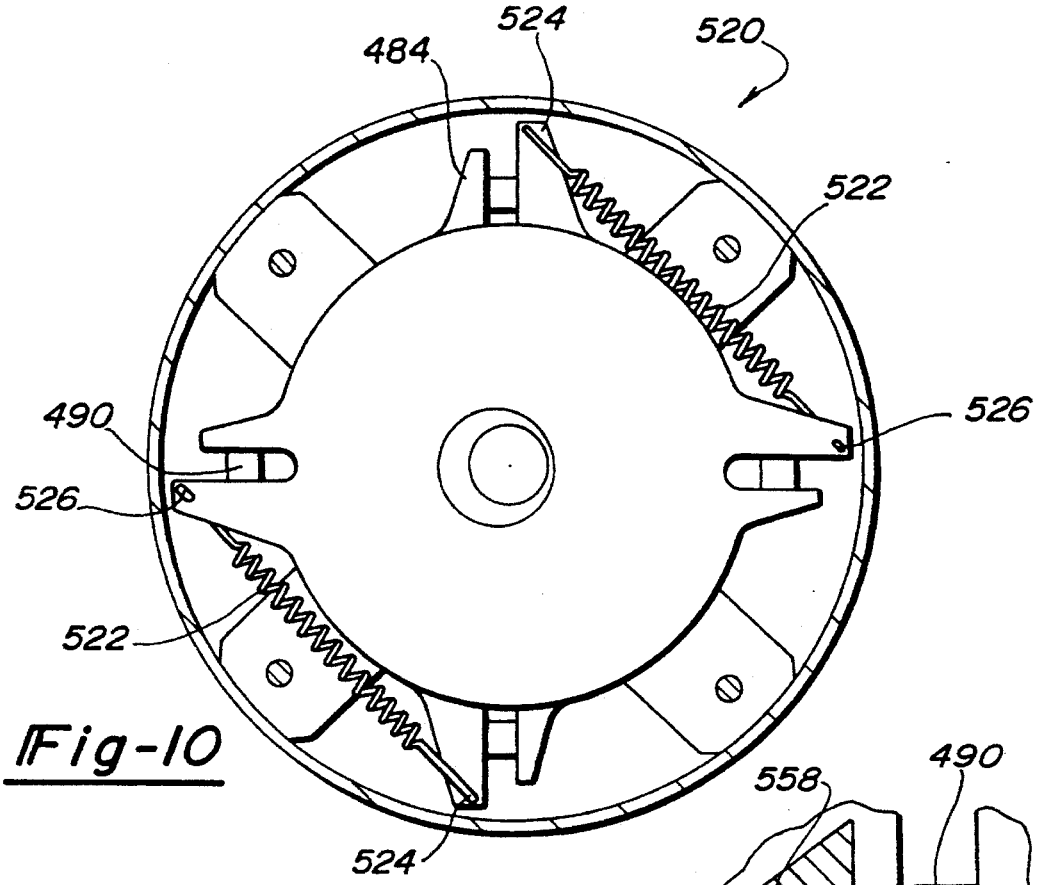
FIG. 10 is a top plan view showing the biasing of one scroll member with respect to the second scroll member on an compressor incorporating an Oldham Coupling according to another embodiment of the present invention.

Referring now to FIG. 10, there is shown an additional embodiment of the biasing system for biasing a dual rotating scroll compressor which is designated generally by the reference numeral 520. Biasing system 520 comprises a pair of biasing extension springs 522 having one end secured to lower scroll 484 at 524 and the opposite end secured to upper scroll 462 at 526. Similar to the embodiment shown in FIG. 9, both upper scroll 462 and lower scroll 484 are biased with respect to each other, the torsional load acting through the keys of Oldham Coupling 490.

Figure 12:
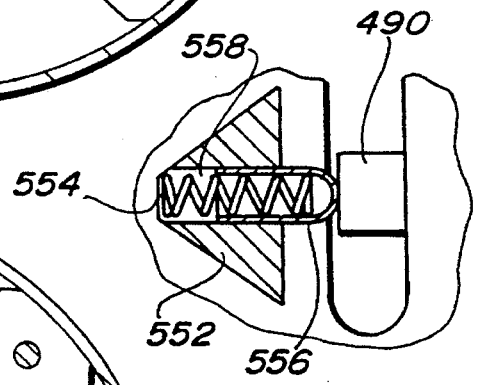
FIG. 12 is an enlarged view showing the biasing system of the compressor shown in FIG. 11.
Figure 11:
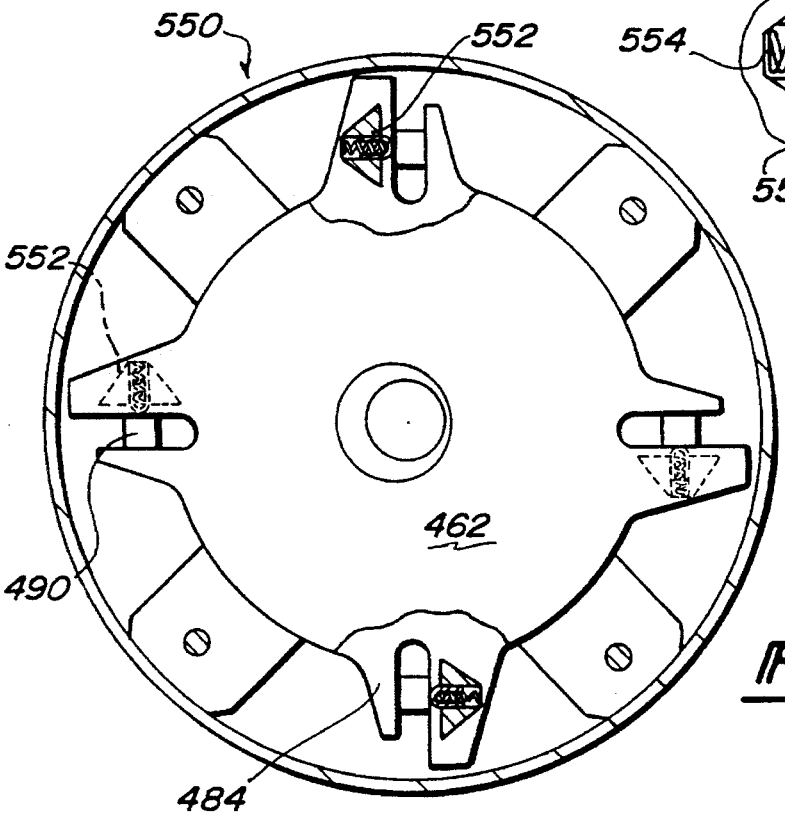
FIG. 11 is a top plan view showing the biasing of one scroll member with respect to the second scroll member and the Oldham Coupling on a compressor incorporating an Oldham Coupling according to another embodiment of the present invention.

Referring now to FIG. 11 and 12, there is shown an additional embodiment of the biasing system for biasing a dual rotating scroll compressor which is designated generally by the reference numeral 550. In the embodiment shown in FIGS. 11 and 12, upper scroll 462 and lower scroll 484 are each provided with a pair of pads 552 each of which is adapted for mounting a coil spring 554 and a plunger 556. Coil spring 554 and plunger 556 are disposed within an aperture 558 located within each pad 552. Coil spring 554 biases plunger 556 outward against a respective key of Oldham Coupling 490 to bias upper scroll 462 or lower scroll 484 against a respective face located on the respective key of Oldham coupling 490. The rate of compression of coil springs 554 in conjunction with the positioning of pads 552 determines the desired moment loading. In the preferred embodiment, plungers 556 are shown as a pair of plungers for each scroll 462 and 484 in order to provide a pure moment load. It is to be understood that only one plunger 556 for each scroll could be used if desired. The ends of plunger 556 are rounded and are designed to slide along the respective key of Oldham Coupling 490 in order to accommodate the relative motion of Oldham Coupling 490 with respect to upper and lower scrolls 462 and 484.

Figure 13:
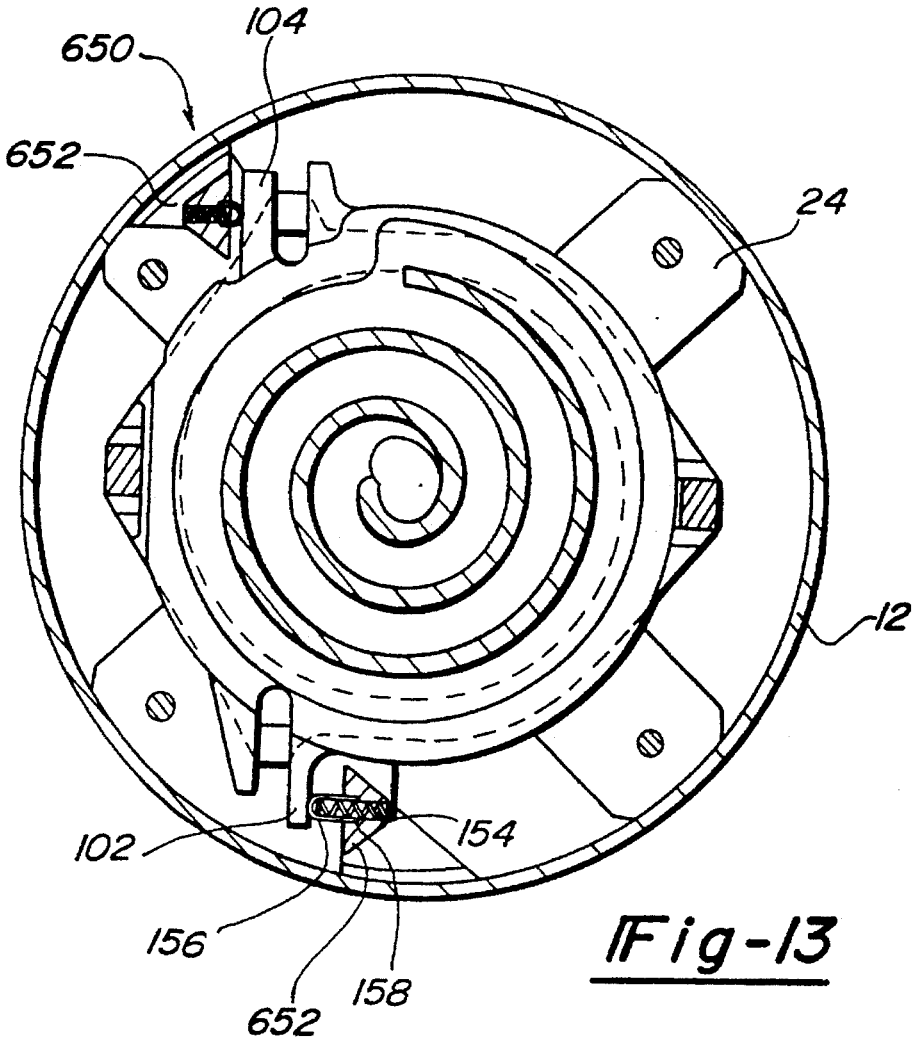
FIG. 13 is a view similar to FIG. 6 but showing the biasing member being anchored to the shell.
Figure 14:
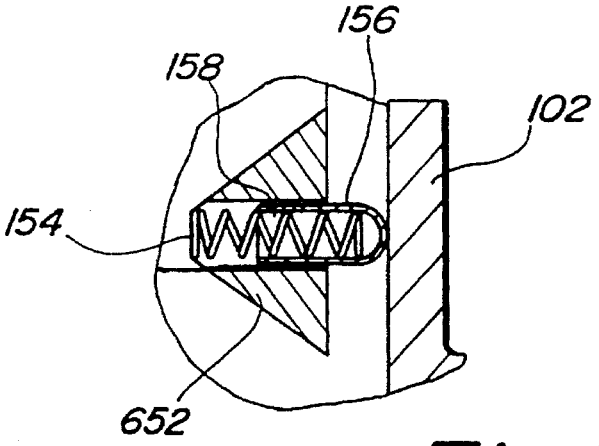
FIG. 14 is an enlarged view of the biasing member shown in FIG. 13.

FIGS. 13 and 14 show another embodiment of the biasing means of the present invention which is designated generally by the reference numeral 650. In the embodiment shown in FIGS. 13 and 14, shell 12 is provided with a pair of brackets 652 each of which is connected to shell 12 and is adapted for mounting a coil spring 154 and a plunger 156. Coil spring 154 and plunger 156 are disposed within an aperture 158 located within each bracket 652. Coil spring 154 biases plunger 156 outward against outwardly projecting flange portions 102 and 104 of orbiting scroll 54 to provide a torsional moment to orbiting scroll 54. The rate of compression of coil spring 154 in conjunction with the positioning of brackets 652 determines the desired moment loading. In the preferred embodiment, plungers 156 are shown as a pair of plungers in order to provide a pure moment load. It is to be understood that only one plunger 156 could be used if desired. The ends of plungers 156 are rounded and are designed to slide along flange portions 102 and 104 of orbiting scroll 54. Thus, to accommodate the orbiting motion of orbiting scroll 54, plungers 156 will both slide along flange portions 102 and 104 as well as move in and out of apertures 158.

The above embodiments of the present invention all offer the same advantages. The spring or springs apply the necessary moment load directly to the scrolls. The moment load is independent of the specific scroll design parameters, the compressor size and the operating conditions. The applied moment does not vary with crank angle and the addition of the spring does not greatly affect any of the other scroll forces such as flank contact forces.

While the above detailed description describes the preferred embodiment of the present invention, it should be understood that the present invention is susceptible to modification, variation and alteration without deviating from the scope and fair meaning of the subjoined claims.

What is claimed is:

1. A scroll-type machine comprising:

a first scroll member having a first spiral wrap projecting outwardly from an end plate;

a second scroll member having a second scroll wrap projecting outwardly from an end plate, said second spiral wrap interleaved with said first spiral wrap to define a plurality of fluid chambers therebetween;

a powered drive shaft rotatably supported by a bearing housing, said drive shaft being drivingly connected to said second scroll member to cause said scroll members to cyclically orbit relative to one another to move said fluid chambers; and a biasing member disposed between said second scroll member and another component of said compressor for urging said second scroll member in a single specified torsional direction during the entire cycle of said orbiting motion of said second scroll member.

2. The scroll-type machine according to claim 1 further comprising a motion controlling member for preventing relative rotation between said first and second scroll members.

3. The scroll-type machine according to claim 1 wherein said first and second scroll members rotate relative to said housing during said orbiting motion of said scroll members.

4. The scroll-type machine according to claim 1 wherein said biasing member is disposed between said bearing housing and said second scroll member.

5. The scroll-type machine according to claim 1 wherein said second scroll member is disposed within a shell, said biasing member being disposed between said shell and said second scroll member.

6. The scroll-type machine according to claim 1 wherein said biasing member comprises a torsional spring.

7. The scroll-type machine according to claim 1 wherein said biasing member comprises at least one coil spring.

8. The scroll-type machine according to claim 1 wherein said specified torsional direction is additive to torsional load exerted by fluid pressure within said fluid chambers.

9. A scroll-type machine comprising:

a non-orbiting scroll member having a first spiral wrap projecting outwardly from an end plate;

an orbiting scroll member having a second scroll wrap projecting outwardly from an end plate, said second scroll wrap interleaved with said first spiral wrap to define a plurality of fluid chambers therebetween;

a drive shaft rotatably supported by a bearing housing, said drive shaft being drivingly connected to said orbiting scroll member to cause said orbiting scroll to cyclically orbit relative to said non-orbiting scroll; and a biasing member disposed between said bearing housing and said orbiting scroll member, said biasing member urging said orbiting scroll member in a single specified torsional direction during the entire cycle of said said orbiting motion of said orbiting scroll member.

10. The scroll-type machine according to claim 9 further comprising a motion controlling member for preventing relative rotation between said non-orbiting scroll and said orbiting scroll.

11. The scroll-type machine according to claim 9 wherein said biasing member comprises a torsional spring.

12. The scroll-type machine according to claim 9 wherein said specified torsional direction is additive to torsional load exerted by fluid pressure within said fluid chambers.

13. A scroll-type machine comprising:

a shell;

a non-orbiting scroll member disposed in said shell and having a first spiral wrap projecting outwardly from an end plate;

an orbiting scroll member disposed in said shell and having a second scroll wrap projecting outwardly from an end plate, said second scroll wrap interleaved with said first spiral wrap to define a plurality of moving fluid chambers therebetween;

a drive shaft rotatably supported by a bearing housing, said drive shaft being drivingly connected to said orbiting scroll member to cause said orbiting scroll to cyclically orbit relative to said non-orbiting scroll; and a biasing member disposed between said shell and said orbiting scroll member, said biasing member urging said orbiting scroll member in a single specified torsional direction during the entire cycle of said orbiting motion of said orbiting scroll member.

14. The scroll-type machine according to claim 13 further comprising a motion controlling member for preventing relative rotation between said non-orbiting scroll and said orbiting scroll.

15. The scroll-type machine according to claim 13 wherein said biasing member comprises at least one coil spring.

16. The scroll-type machine according to claim 13 wherein said specified torsional direction is additive to torsional load exerted by fluid pressure within said fluid chambers.

* * * * *